US011097143B2

(12) United States Patent
Li et al.

(10) Patent No.: US 11,097,143 B2
(45) Date of Patent: Aug. 24, 2021

(54) SUSPENSION TRAINING STRAP HANDLE AND SUSPENSION TRAINING STRAP

(71) Applicant: Quanzhou Economic and Technological Development Zone Fuxin Sports Equipment Co., Ltd., Fujian Province (CN)

(72) Inventors: Linlin Li, Quanzhou (CN); Yichen Li, Quanzhou (CN)

(73) Assignee: QUANZHOU ZHONGLONG INFORMATION TECHNOLOGY SERVICE CO., LTD., Quanzhou (CN)

( * ) Notice: Subject to any disclaimer, the term of this patent is extended or adjusted under 35 U.S.C. 154(b) by 0 days.

(21) Appl. No.: 16/429,582

(22) Filed: Jun. 3, 2019

(65) Prior Publication Data

US 2020/0346062 A1 Nov. 5, 2020

(30) Foreign Application Priority Data

Apr. 30, 2019 (CN) ..... 201910362479.6
Apr. 30, 2019 (CN) ..... 201920620832.1

(51) Int. Cl.
*A63B 21/04* (2006.01)
*A63B 21/055* (2006.01)
(Continued)

(52) U.S. Cl.
CPC .... *A63B 21/0442* (2013.01); *A63B 21/00043* (2013.01); *A63B 21/0552* (2013.01); *A63B 21/068* (2013.01); *A63B 21/1627* (2013.01); *A63B 21/4035* (2015.10); *A63B 23/03541* (2013.01); *A63B 23/12* (2013.01); *A63B 2225/09* (2013.01)

(58) Field of Classification Search
CPC ..... A63B 21/0442; A63B 21/0552; A63B 21/1627; A63B 21/00185; A63B 21/04; A63B 21/05–0557; A63B 21/068; A63B 21/16; A63B 21/1618; A63B 21/0645; A63B 21/1663; A63B 21/169; A63B 21/4013; A63B 21/4015; A63B 21/4019; A63B 21/4021; A63B 21/4033–4035; A63B 23/03541; A63B 23/12; A63B 23/0355; A63B 7/02; A63B 22/0002; A63B 2023/006
See application file for complete search history.

(56) References Cited

U.S. PATENT DOCUMENTS 9,259,605 B1 * 2/2016 Puig ..... A63B 21/16
9,597,541 B2 * 3/2017 Hinds ..... A63B 21/16
(Continued)

*Primary Examiner* — Megan Anderson
*Assistant Examiner* — Kathleen Vermillera

(57) ABSTRACT

A suspension training strap handle and a suspension training strap solve the technical problem that an edge of a thin edge of a strap body contacts with the human limb and generate pressure so as to be easy to generate a mark and damage the skin when the existing suspension training strap is used. The suspension training strap handle includes handle bodies, strap connection structures arranged on the handle bodies and gripping parts; wherein the stiffness of a material of the handle body is greater than that of a flexible strap body; one end of the flexible strap body of the training strap is connected to the strap body connection structure while the other end thereof can be connected to an external fixing device.

9 Claims, 6 Drawing Sheets

(51) Int. Cl.

| | |
|---|---|
| ***A63B 23/12*** | (2006.01) |
| ***A63B 21/00*** | (2006.01) |
| ***A63B 23/035*** | (2006.01) |
| ***A63B 21/16*** | (2006.01) |
| ***A63B 21/068*** | (2006.01) |

(56) References Cited

U.S. PATENT DOCUMENTS

| | | | | |
|---|---|---|---|---|
| 10,369,399 | B2 * | 8/2019 | Ross | A63B 21/00065 |
| 2006/0052223 | A1 * | 3/2006 | Terry | A63B 21/0004<br>482/126 |
| 2013/0005544 | A1 * | 1/2013 | Butler | A63B 21/1663<br>482/139 |
| 2014/0221178 | A1 * | 8/2014 | Wagner | A63B 21/00043<br>482/126 |
| 2014/0252598 | A1 * | 9/2014 | Yu | H01L 24/13<br>257/737 |
| 2015/0283420 | A1 * | 10/2015 | Chang | A63B 23/1281<br>482/129 |
| 2015/0306445 | A1 * | 10/2015 | Storum | A63B 21/4034<br>16/110.1 |
| 2017/0361150 | A1 * | 12/2017 | Polinsky | A63B 21/16 |

* cited by examiner

SUSPENSION TRAINING STRAP HANDLE AND SUSPENSION TRAINING STRAP

CROSS REFERENCE TO RELATED APPLICATION

This applications takes priority from and claims the benefit of Chinese Patent Application 201910362479.6 filed on Apr. 30, 2019 and Chinese Patent Application 201920620832.1 filed on Apr. 30, 2019, the contents of which are herein incorporated by reference.

TECHNICAL FIELD

The present disclosure relates to the technical field of suspension training straps, and in particular, to a suspension training strap handle and a suspension training strap with the same.

BACKGROUND

A training strap is portable training equipment, which is widely applied due to its characteristics of mounting convenience, collection convenience and high field applicability. For example, the Chinese Patent Application No. CN208599056U discloses a combined suspension training strap (as shown in FIG. 1), comprising a first support strap 1', wherein a first hook 11' is arranged at the upper tail end of the first support strap 1'. The combined suspension training strap is characterized by further comprising a second support strap 2' and two training straps 3', the second support strap 2' is connected to the first support strap 1' and is provided with two lateral suspension loops 21', one end of each training strap 3' is provided with a second hook 31' while the other end thereof is provided with a grip 32', and the two training straps 3' can be detachably connected to the lateral suspension loops 21' through the second hooks 31'. A strap body of the training strap 3' generally is flat, a handle of the existing training strap generally is hollow cylindrical, and the flat strap body is connected after passing through a hollow part of the handle.

The applicant finds that: when the suspension training strap provided by the prior art is in use, an edge of a thin edge of the strap body contacts with the human limb and generates a pressure so as to be easy to generate a mark and damage the human skin.

SUMMARY

An objective of the present disclosure is to provide a suspension training strap handle and a suspension training strap with the same, in order to solve the technical problem that an edge of a thin edge of a strap body contacts with the human limb and generates pressure so as to be easy to generate a mark and damage the human skin when the suspension training strap is in use in the prior art. The following describes in detail multiple technical effects capable of being generated by a preferred technical solution of multiple technical solutions provided by the present disclosure.

To achieve the above objective, the present disclosure provides the following technical solutions.

A suspension training strap handle provided by embodiments of the present disclosure comprises handle bodies, strap body connection structures arranged on the handle bodies and gripping parts; wherein the stiffness of a material of the handle body is greater than that of a flexible strap body;

one end of the flexible strap body of the training strap is connected to the strap body connection structure while the other end thereof can be connected to an external fixing device; and a gap always exists between an edge of a thin edge of the flexible strap body and the human limb when the human hand grips the gripping part and straightens the flexible strap body.

In a preferable or optional embodiment, the strap body connection structure is arranged at the upper portion of the handle body, the bottom of the handle body forms the gripping part, and an arrangement direction of four fingers when the human hand grips the gripping part is the width direction of the handle body; due to the strap body connection structure, the flexible strap body can be connected to the suspension training strap handle, and the width direction of the flexible strap body is in parallel with the width direction of the handle body; and when the human hand grips the gripping part, the front surface or the back surface of the flexible strap body is oriented to the human limb.

In a preferable or optional embodiment, the strap body connection structure is a strap body connecting hole arranged on the handle body, the depth direction of the strap body connecting hole is vertical to the width direction of the handle body, and the flexible strap body is connected to the handle body after passing through the strap body connecting hole such that the width direction of the flexible strap body is in parallel with the width direction of the handle body.

In a preferable or optional embodiment, the strap body connecting hole is a slit-shaped hole penetrating through the upper portion of the handle body and having the width direction of an opening in the width direction of the handle body, the height of the opening of the strap body connecting hole is greater than the thickness of the flexible strap body and less than doubled thickness of the flexible strap body, and the width of the opening of the strap body connecting hole is not less than the width of the flexible strap body; and the width direction of the strap body connecting hole is in parallel to the width direction of the handle body.

In a preferable or optional embodiment, the handle body has a triangular annular structure, and the bottom edge of the handle body forms the gripping part, foot strap connecting blocks are arranged at the left end and the right end of the gripping part, a foot strap connecting hole is formed in the foot strap connecting block, and two ends of a foot strap can pass through the foot strap connecting holes in the two ends of the gripping part such that the front surface or the back surface of the foot strap is oriented to the gripping part.

In a preferable or optional embodiment, the foot strap connecting blocks are respectively inclined downwards and inwards; and the foot strap connecting hole is a slit-shaped hole, the width direction of the foot strap connecting hole is vertical to the front surface and the back surface of the handle body, and the depth direction of the foot strap connecting hole is inclined downwards and inwards.

The suspension training strap provided by the embodiments of the present disclosure comprises the foot straps, strap bodies and the training strap handle provided by any technical solution of the present disclosure, and the foot straps and the strap bodies are flat, wherein one end of the strap body is folded after passing through the strap body connecting hole, and then an end part of the strap body is fixed to the strap body such that the strap body and the handle body are connected; and two ends of the foot strap respectively pass through the foot strap connecting holes, the two ends of the foot strap are folded and then sewn to form open slots, and a blind end of the open slot abuts against a top wall surface of the foot strap connecting hole so as to be capable of preventing the foot strap from getting out of the foot strap connecting hole.

In a preferable or optional embodiment, the suspension training strap further comprises a fixing strap, the fixing strap is arranged in a forky manner, and the top end of the fixing strap is provided with a fixing hook, wherein the upper portion is sewn, the portion below a sewn part is forky to form two connecting straps, and each connecting strap can be connected with the strap body; and a connecting hook is arranged at one of one end, away from the suspension training strap handle, of the strap body and one end, away from a forky part, of the connecting strap while a connection part is arranged at the other one, and the connecting hook is connected with the interior of the connection part in a hooking manner so as to be capable of connecting the strap body with the connecting strap.

In a preferable or optional embodiment, the suspension training strap further comprises a chest developer, the chest developer comprises a pull rope and pull handles, two ends of the pull rope are respectively provided with the pull handle, and the pull rope is an elastic strap body; and the fixing strap extends downwards from the forky part and is provided with an annular strap, and one end of the chest developer can pass through the annular strap such that the pull rope is connected to the annular strap in a hanging manner.

In a preferable or optional embodiment, the strap body is provided with a strap body adjusting buckle which can adjust the length of the strap body; and or the foot strap is provided with a foot strap adjusting buckle which can adjust the length of the foot strap.

Based on the above technical solution, embodiments of the present disclosure at least can generate the following technical effects:

the suspension training strap handle provided by the present disclosure comprises the handle bodies, the strap body connection structures arranged on the handle bodies and the gripping parts, the flexible strap body can be connected to the handle body through the strap body connection structure, and the stiffness of the material of the handle body is greater than that of the flexible strap body; therefore, in the training process, the skin of the human hand contacts with the handle body, the gap exists between the edge of the flexible strap body and the skin of the human hand, and the gap always exists between the edge of the flexible strap body and the human limb when the human hand grips the gripping part and straightens the flexible strap body, so as to prevent the edge of the flexible strap body from generating the pressure to the skin of the human limb in the training process and damaging the skin of the human limb.

BRIEF DESCRIPTION OF THE DRAWINGS

To describe the technical solutions in the embodiments of the present disclosure or in the prior art more clearly, the following briefly describes the accompanying drawings required for describing the embodiments or the prior art. Apparently, the accompanying drawings in the following description show some embodiments of the present disclosure, and a person of ordinary skill in the art may still derive other drawings from these accompanying drawings without creative efforts.

Figure 1:
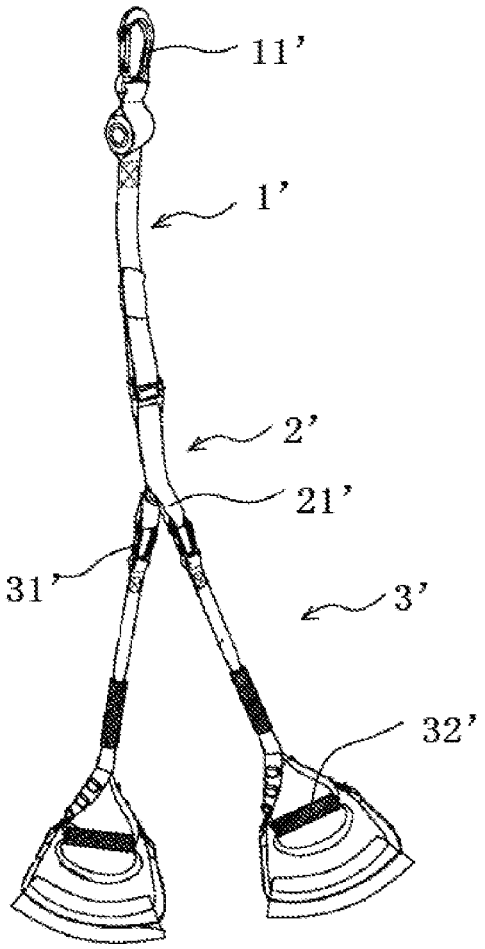
FIG. 1 PRIOR ART
FIG. 1 is a schematic diagram of a combined suspension training strap in the prior art.

In the drawings: 1—handle body, 2—strap body connection structure, 3—gripping part, 4—foot strap connecting block, 41—foot strap connecting hole, 5—foot strap, 51—open slot, 52—foot strap adjusting buckle, 6—strap body, 61—connecting hook, 62—strap body adjusting buckle, 7—fixing strap, 71—fixing hook, 72—connecting strap, 721—connection part, 73—annular strap, 8—chest developer, 81—pull rope, and 82—pull handle.

DESCRIPTION OF THE EMBODIMENTS

To make the objectives, technical solutions, and advantages of the present disclosure clearer, the following describes the technical solutions of the present disclosure in detail. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

The present disclosure provides a suspension training strap handle and a suspension training strap which can ensure that a gap always exists between an edge of a thin edge of a strap body and the human limb in a training process in order to prevent the edge of the strap body from damaging the human skin.

The technical solution provided by the present disclosure will be described below in more detail with reference to FIG. 1 to FIG. 6.

As shown in FIG. 1 to FIG. 6, a suspension training strap handle provided by the present disclosure comprises handle bodies 1, strap body connection structures 2 arranged on the handle bodies 1 and gripping parts 3; wherein the stiffness of a material of the handle body 1 is greater than that of a flexible strap body;

one end of the flexible strap body of the training strap is connected to the strap body connection structure 2 while the other end thereof can be connected to an external fixing device; and a gap always exists between the edge of the thin edge of the flexible strap body and the human limb when the human hand grips the gripping part 3 and straightens the flexible strap body.

Specifically, the material of the handle body 1 may be nylon engineering plastic, the flexible strap body may be a high-tenacity polyester webbing, the stiffness of the nylon engineering plastic is greater than that of the high-tenacity polyester webbing, the nylon engineering plastic is not easy to deform in use, the outer contour of the handle body 1 has rounded transitions, and in use, the handle body 1 exists in a space around the human hand, so the flexible strap body cannot contact with the skin of the human hand to be prevented from generating a mark on the skin of the human hand.

The external fixing device may be a first support strap 1' in the Chinese Patent Application No. CN208599056U, wherein a first hook 11' at the top end of the first support strap 1' can be connected to a fixed rod, or a stop block 13' at the top end of the first support strap 1' can be connected to a door frame.

The suspension training strap handle provided by the present disclosure comprises the handle bodies 1, the strap body connection structures 2 arranged on the handle bodies 1 and the gripping parts 3, the flexible strap body can be connected to the handle body 1 through the strap body connection structure 2, and the stiffness of the material of the handle body is greater than that of the flexible strap body; therefore, in the training process, the skin of the human hand contacts with the handle body 1, the gap exists between the edge of the flexible strap body and the skin of the human hand, and the gap always exists between the edge of the flexible strap body and the human limb when the human hand grips the gripping part 3 and straightens the flexible strap body, so as to prevent the edge of the flexible strap body from generating the pressure to the skin of the human limb in the training process and damaging the skin of the human limb.

As a preferable or optional embodiment, the strap body connection structure 2 is arranged at the upper portion of the handle body 1, the bottom of the handle body 1 forms the gripping part 3, and an arrangement direction of four fingers when the human hand grips the gripping part 3 is the width direction of the handle body 1; due to the strap body connection structure 2, the flexible strap body can be connected to the suspension training strap handle, and the width direction of the flexible strap body is in parallel with the width direction of the handle body 1; and when the human hand grips the gripping part 3, the front surface or the back surface of the flexible strap body is oriented to the human limb.

In use, when the human hand grips the gripping part 3 and stretches the flexible strap body, because the front surface or the back surface of the flexible strap body is oriented to the human limb, the front surface or the back surface of the flexible strap body is always in contact with the human limb even if the flexible strap body comes into contact with the human limb, wherein the stress area is large such that the generated pressure is small, and the mark is hard to generate; furthermore, because the surface of the human limb has the radian, the edge of the thin edge of the flexible strap body is turned up and always has the gap with the outer surface of the human limb when the front surface or the back surface of the flexible strap body is in contact with the human limb.

As a preferable or optional embodiment, the strap body connection structure 2 is a strap body connecting hole arranged on the handle body 1, the depth direction of the strap body connecting hole is vertical to the width direction of the handle body 1, and the flexible strap body is connected to the handle body 1 after passing through the strap body connecting hole such that the width direction of the flexible strap body is in parallel with the width direction of the handle body 1.

Figure 2:
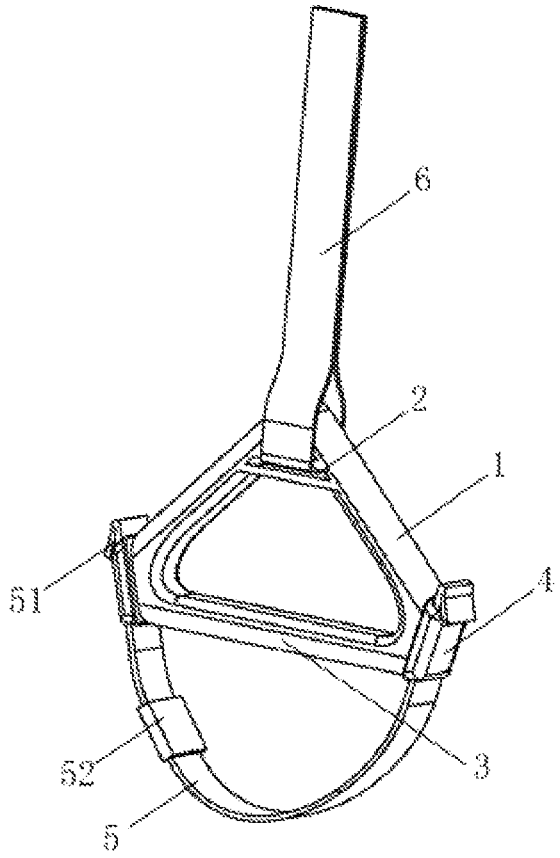
FIG. 2 is a schematic diagram of connecting a suspension training strap handle with a strap body and a foot strap provided in embodiments of the present disclosure.
Figure 3:
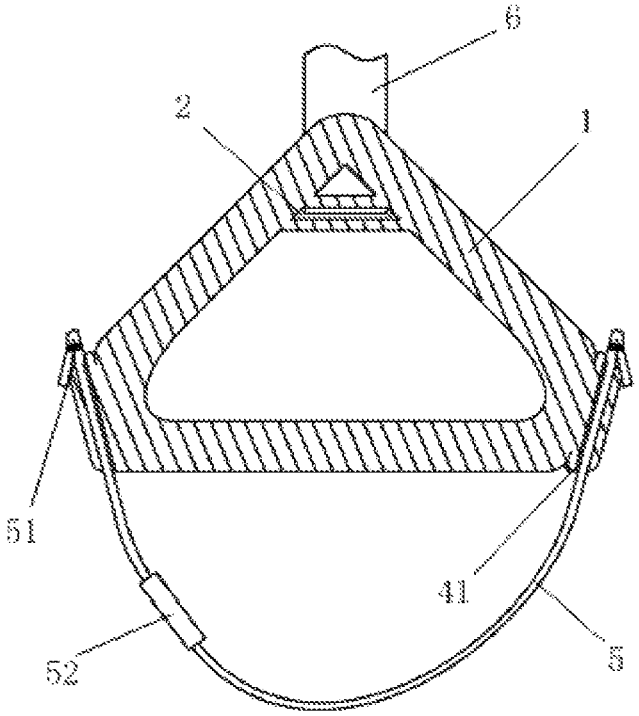
FIG. 3 is a schematic diagram of a cross section of connecting the suspension training strap handle with the strap body and the foot strap as shown in FIG. 2.
Figure 4:
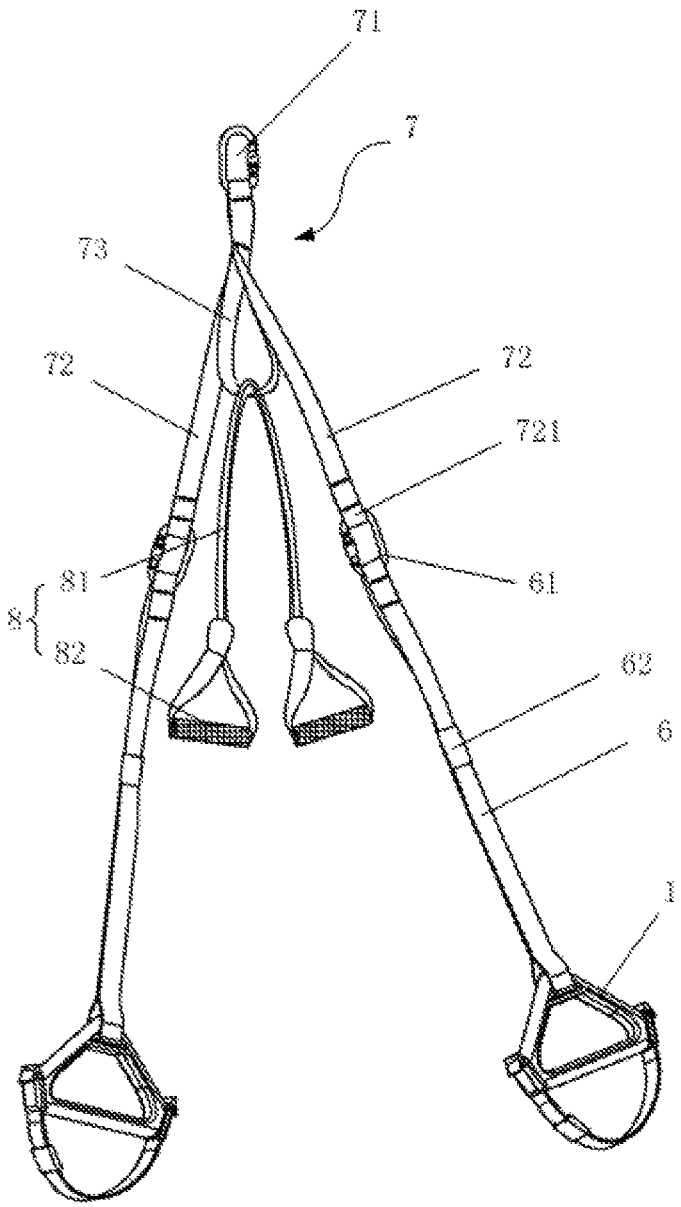
FIG. 4 is a schematic diagram of a suspension training strap provided in embodiments of the present disclosure.
Figure 5:
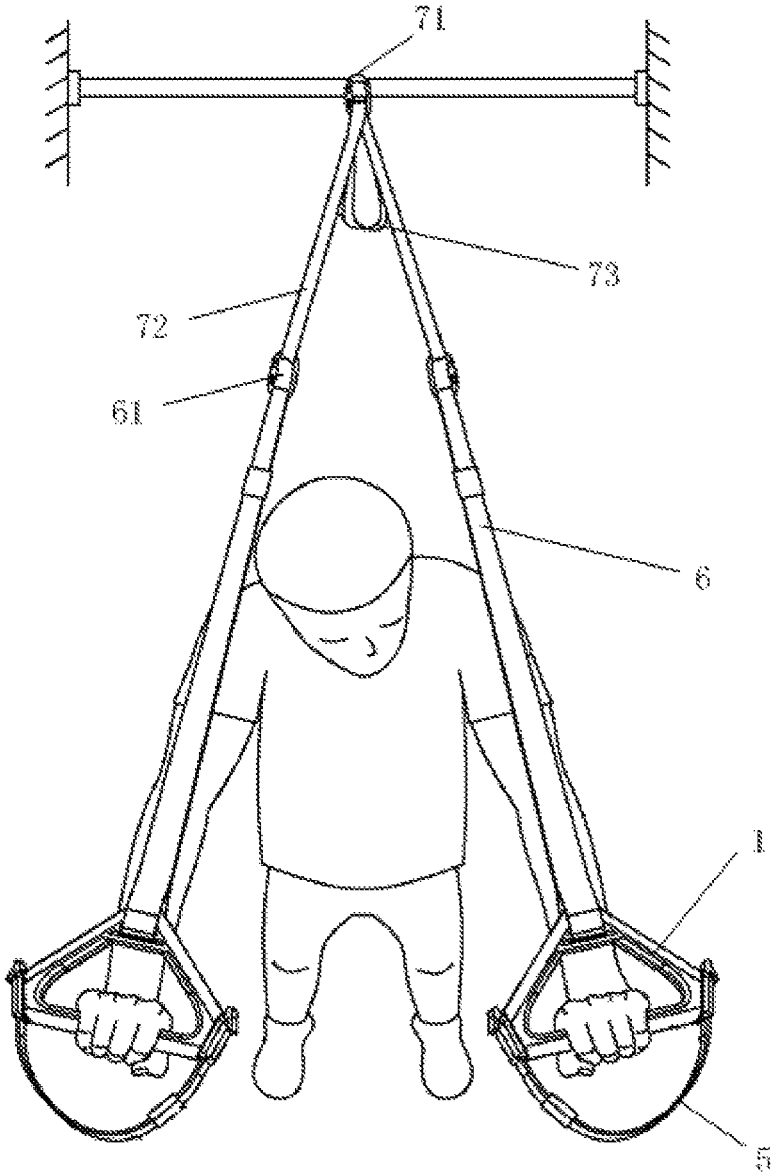
FIG. 5 is a schematic diagram of a use state of the suspension training strap provided in embodiments of the present disclosure.
Figure 6:
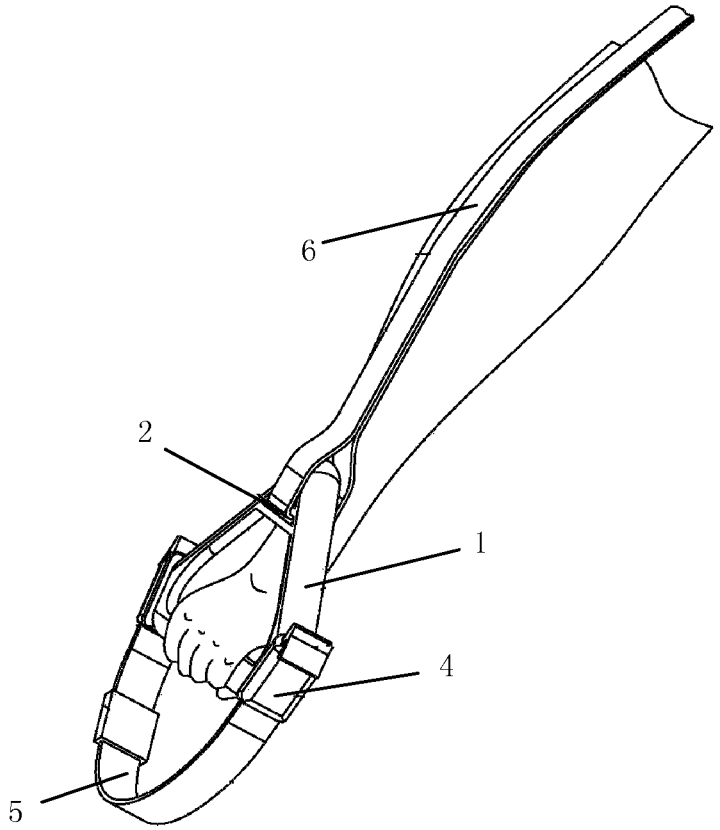
FIG. 6 is a schematic diagram of a contact state of the strap body and the arm when the suspension training strap as shown in FIG. 5 is in use.

Specifically, as shown in FIG. 2, one end of the flexible strap body can be fixed to the flexible strap body after passing through the strap body connecting hole and being folded, and because the depth direction of the strap body connecting hole is vertical to the width direction of the handle body 1, the passing direction of the flexible strap body is vertical to the width direction of the handle body 1. In this case, as shown in FIG. 6, the front surface or the back surface of the flexible strap body is always oriented to the surface of the human limb after the human hand grips the gripping part 3 and straightens the flexible strap body in use.

As a preferable or optional embodiment, the strap body connecting hole is a slit-shaped hole penetrating through the upper portion of the handle body 1 and having the width direction of an opening in the width direction of the handle body 1, the height of the opening of the strap body connecting hole is greater than the thickness of the flexible strap body and less than doubled thickness of the flexible strap body, and the width of the opening of the strap body connecting hole is not less than the width of the flexible strap body; and the width direction of the strap body connecting hole is in parallel to the width direction of the handle body 1.

Specifically, because the flexible strap body is flat, the height of the opening of the strap body connecting hole is limited to be slightly greater than the thickness of the flexible strap body and less than the doubled thickness of the flexible strap body so as to be capable of ensuring that the flexible strap body does not turn over after passing through the strap body connecting hole, and the width of the opening of the strap body connecting hole is limited to be not less than the width of the flexible strap body so as to be capable of ensuring the smoothness of the flexible strap body in use and to further prevent the edge of the flexible strap body from damaging the human skin; and the width direction of the strap body connecting hole is limited to be in parallel with the width direction of the handle body 1 so as to be capable of ensuring that a stretching direction of the flexible strap body is in a stretching direction of the human limb in use and improve the comfortableness in use.

As a preferable or optional embodiment, the handle body 1 has a triangular annular structure, and its bottom edge forms the gripping part 3, foot strap connecting blocks 4 are arranged at the left end and the right end of the gripping part 3, a foot strap connecting hole 41 is formed in the foot strap connecting block 4, and two ends of a foot strap can pass through the foot strap connecting holes 41 in the two ends of the gripping part 3 such that the front surface or the back surface of the foot strap is oriented to the gripping part 3.

As a preferable or optional embodiment, the foot strap connecting blocks 4 are respectively inclined downwards and inwards; and the foot strap connecting hole 41 is a slit-shaped hole, its width direction is vertical to the front surface and the back surface of the handle body 1, and its depth direction is inclined downwards and inwards.

Specifically, the handle body 1 has the triangular annular structure, the palm of a user is placed in the annular structure when the user grips the handle body 1, and the annular structure has a constant size so as to solve a friction problem when the back of the palm is in contact with the flexible strap body; the foot strap is also flat, and the front surface or the back surface of the foot strap is oriented to the gripping part 3 after two ends of the foot strap pass through the foot strap connecting holes 41 so as to be capable of ensuring that the front surface or the back surface of the foot strap contacts with the human foot when the foot strap is used; and the foot strap connecting blocks 4 are arranged at the left end and the right end of the gripping part 3 such that a gap always exists between the foot strap and the human foot in use, thereby avoiding friction generated by contact of the foot strap and the surface of the human foot, and improving the comfortableness in use.

The suspension training strap provided by the embodiments of the present disclosure comprises the foot straps 5, strap bodies 6 and the training strap handle provided by any technical solution of the present disclosure, and the foot straps 5 and the strap bodies 6 are flat, wherein one end of the strap body 6 is folded after passing through the strap body connecting hole, and then an end part of the strap body 6 is fixed to the strap body 6 such that the strap body 6 and the handle body 1 are connected; and two ends of the foot strap 5 respectively pass through the foot strap connecting holes 41, the two ends of the foot strap 5 are folded and then sewn to form open slots 51, and a blind end of the open slot 51 abuts against the top wall surface of the foot strap connecting hole 41 so as to be capable of preventing the foot strap 5 from getting out of the foot strap connecting hole 41.

As a preferable or optional embodiment, the suspension training strap further comprises a fixing strap 7, the fixing strap 7 is arranged in a forky manner, and the top end of the fixing strap 7 is provided with a fixing hook 71, wherein the upper portion is sewn, the portion below a sewn part is forky to form two connecting straps 72, and each connecting strap 72 can be connected with the strap body 6; and a connecting hook 61 is connected to one end of the strap body 6 and to a connection part 721 of the connecting strap 72 such that the strap body 6 and the connecting strap 72 are connected via the connecting hook 61.

Specifically, the fixing strap 7 and the connecting strap 72 can have an integral structure and can also be connected by sewing; the connecting hook 61 can be arranged on the strap body 6, and the connection part 721 is arranged on the connecting strap 72; wherein the strap body 6 is annular and connected end to end, the connecting hook 61 is connected with the annular structure of the strap body in the hooking manner, two portions of the annular structure are sewn at a hooked connection part, and the connecting hook 61 is fixed to the end part of the strap body 6; and the connecting strap 72 also has the annular structure, the connection part 721 is formed at the tail end of the connecting strap 72, and the connecting hook 61 is connected with the connection part 721 in the hooking manner so as to achieve connection of the strap body 6 and the connecting strap 72.

Generally, one fixing strap 7 is correspondingly provided with two connecting straps 72, and when the user carries out a stretching operation simultaneously by two hands or two feet, the tail ends of the two connecting straps 72 can be connected to the strap bodies 6; and when the user carries out a stretching operation only by one limb, one strap body 6 can be detached, and only one strap body 6 is used.

As a preferable or optional embodiment, the suspension training strap further comprises a chest developer 8, the chest developer 8 comprises a pull rope 81 and pull handles 82, each end of the pull rope 81 is provided with a pull handle 82, and the pull rope 81 is an elastic strap body; and the fixing strap 7 extends downwards from the forky part and is provided with an annular strap 73, and one end of the chest developer 8 can pass through the annular strap 73 such that the pull rope 81 is connected to the annular strap 73 in a hanging manner.

Specifically, the annular strap 73 and the fixing strap 7 can be connected in a sewing manner; when the chest developer 8 is used for training, the strap bodies 6 are detached from the connecting straps 72, and only the chest developer 8 is used, thereby simplifying the structure and preventing unnecessary collision between the human body and the strap bodies 6 or the handle bodies 1 in the training process.

As a preferable or optional embodiment, the strap body 6 is provided with a strap body adjusting buckle 62 which can adjust the length of the strap body; and or the foot strap 5 is provided with a foot strap adjusting buckle 52 which can adjust the length of the foot strap 5.

Specifically, the strap body adjusting buckle 62 and the foot strap adjusting buckle 52 may be any conventional buckle on the market at present, such as a tri-glide button, a ladder lock, a cord fastener and the like. Arrangement of the strap body adjusting buckle 62 may help the suspension training strap to be applicable to trainers of different heights, and arrangement of the foot strap adjusting buckle 52 may help the foot strap 5 to be applicable to the trainer of different foot widths, so the application range is wider, and adjustment flexibility is higher.

Furthermore, a stopper is arranged between the fixing hook 71 and the forky part of the fixing strap 7, the fixing strap 7 may have an annular structure, the stopper is arranged in the annular structure, a portion of the fixing strap around the stopper is pressed tightly, and then two portions of the annular fixing strap 7 are sewn such that the stopper can be mounted on the fixing strap 7 in an interference fit manner. In use, the stopper can be hung on an upper plate of a door panel; and because the thickness of the stopper is greater than the width of a door seam, the user can clamp the stopper outside the door seam by pulling the fixing strap 7 on the other side of the door panel after closing the door panel.

In any one of the technical solutions disclosed by the present disclosure, unless otherwise indicated, if a numerical range is disclosed, the disclosed numerical range is the preferred numerical range. Those skilled in the art should understand: the preferred numerical range merely is a numerical value with relatively remarkable technical effect or representativity in multiple implementable numerical values. There are too many numerical values which cannot be exhaustively described, so the present disclosure discloses a part of the numerical values for illustrating the technical solutions of the present disclosure, and the above listed numerical values are not intended to limit the protection range of the present disclosure.

If words like "first" and "second" used here are for limiting components, those skilled in the art should know that use of "first" and "second" is only for at the ease of distinguishing the spare parts; unless otherwise indicated, the words have no special meanings.

Furthermore, if the present disclosure discloses or relates to mutually fixedly connected components or structural parts, unless otherwise indicated, the fixed connection may be understood as: detachable fixed connection (such as connection by using a bolt or a screw), and may be also understood as: undetachable fixed connection (such as riveting and welding). Certainly, the mutual fixed connection may also be an integral structure (for example, the integral structure is manufactured by using the foundry technique except that a structure remarkably cannot be manufactured by utilizing an integral formation technique).

Additionally, unless otherwise indicated, the meanings of terms for representing a position relationship or a shape in any one of the technical solutions disclosed by the present disclosure comprise approximate, similar or close states or shapes. Any component provided by the present disclosure can be assembled by a plurality of independent components, and can also be an independent part manufactured by the integral formation technique.

Finally, it should be stated that the embodiments above are only for illustrating the technical solution of the present disclosure, not for limiting it; although the present disclosure have been described in detail with reference to the preferred embodiments, those skilled in the art should understand that the preferred embodiments of the present disclosure may be modified or part of technical features may be replaced in equivalence; without departing from the spirit of the technical solution of the present disclosure, such modifications and equivalent replacements should be covered within the scope of the technical solution as recited in the present disclosure.

What is claimed is:

1. A suspension training strap comprising foot straps, strap bodies, and suspension training strap handles;

wherein each of the foot straps and each of the strap bodies are flat;

wherein each of the suspension training strap handles comprises a handle body, a strap body connection structure arranged on the handle body and a gripping part such that one end of each of the strap bodies is configured to be folded after respectively passing through the corresponding strap body connection structure arranged on the corresponding handle body of each of the suspension training strap handles, and an end part of each of the strap bodies is configured to be fixed to the respective strap bodies such that each of the strap bodies is connected to the corresponding handle body; and wherein each of the foot straps comprise two ends, and the two ends are configured to respectively pass through a foot strap connecting hole, and the two ends of each of the foot straps are configured to be folded and then sewn to form open slots, wherein one end of each of the open slots is configured to abut against a top wall surface of the respective foot strap connecting hole and is capable of preventing each of the foot straps from being removed from the respective foot strap connecting holes;

wherein one end of each of the strap bodies of the suspension training strap is connected to the corresponding strap body connection structure while another end thereof is configured to be connected to an external fixing device;

a stiffness of a material of each of the handle bodies is greater than a stiffness of each of the corresponding strap bodies; and wherein each of the strap bodies is configured to lay flat against a user's limb when the user grips the gripping part of each of the suspension training strap handles and straightens each of the strap bodies.

2. The suspension training strap according to claim 1, wherein each of the strap body connection structures is arranged at an upper portion of the corresponding handle body, and a bottom of the corresponding handle body forms the gripping part; each of the strap bodies is configured to be connected to the corresponding suspension training strap handle, and a width direction of each of the strap bodies is in parallel with the width direction of the corresponding handle body; and wherein a front surface or a back surface of each of the strap bodies is configured to be orientated toward the user's limb when the user grips the respective gripping part.

3. The suspension training strap according to claim 2, wherein each of the strap body connection structures comprises a strap body connecting hole arranged on the corresponding handle body, a depth direction of the strap body connecting hole is vertical to the width direction of the corresponding handle body, and each of the strap bodies is configured to be connected to the corresponding handle body after passing through the strap body connecting hole such that the width direction of the corresponding strap body is in parallel with the width direction of the corresponding handle body.

4. The suspension training strap according to claim 3, wherein each of the strap body connecting holes arranged on the respective handle body is a slit-shaped hole penetrating through the upper portion of the respective handle body and having a width direction of an opening in the width direction of the respective handle body, a height of the opening of the strap body connecting hole is greater than a thickness of the respective strap body and less than doubled the thickness of the respective strap body, and a width of the opening of the strap body connecting hole is not less than a width of the respective strap body; and the width direction of the strap body connecting hole is in parallel to the width direction of the respective handle body.

5. The suspension training strap according to claim 2, wherein each of the handle bodies has a triangular annular structure, and wherein foot strap connecting blocks are arranged at a left end and a right end of the gripping part of each of the handle bodies, each of the foot strap connecting blocks comprises the respective foot strap connecting hole, and the two ends of each foot strap are configured to pass through the foot strap connecting holes in the left and right ends of the respective gripping part such that a front surface or a back surface of the foot strap is oriented to the gripping part.

6. The suspension training strap according to claim 5, wherein each of the foot strap connecting blocks are respectively inclined downwards and inwards; and the foot strap connecting hole of each of the foot strap connecting blocks is a slit-shaped hole, a width direction of the foot strap connecting hole of each of the foot strap connecting blocks is vertical to a front surface and a back surface of the respective handle body, and a depth direction of the foot strap connecting hole of each of the foot strap connecting blocks is inclined downwards and inwards from the respective handle body.

7. The suspension training strap according to claim 1, further comprising a fixing strap, the fixing strap is configured in the shape of a fork, and a top end of the fixing strap is provided with a fixing hook, wherein an upper portion of the fixing strap is configured to be sewn, a portion of the fixing strap below a sewn part is configured to form two connecting straps, and each of the two connecting straps is configured to be connected with one strap body of the strap bodies; and a connecting hook is connected to one end of each of the strap bodies, and to a connection part the respective strap body and connecting strap such that of a respective one of the two connecting straps are connected via the connecting hook.

8. The suspension training strap according to claim 7, further comprising a chest developer, wherein the chest developer comprises a pull rope and pull handles, two ends of the pull rope are respectively provided with one of the pull handles, and the pull rope is an elastic strap body; and the fixing strap extends downwards and is provided with an annular strap, and one end of the chest developer can pass through the annular strap such that the pull rope is connected to the annular strap in a hanging manner.

9. The suspension training strap according to claim 1, wherein each of the strap bodies is provided with a strap body adjusting buckle that is configured to adjust a length of the respective strap body; and/or each of the foot straps is provided with a foot strap adjusting buckle that is configured to adjust a length of the respective foot strap.

* * * * *